US011721313B2

(12) United States Patent
Aval et al.

(10) Patent No.: US 11,721,313 B2
(45) Date of Patent: Aug. 8, 2023

(54) NARROWBAND CANCELLATION

(71) Applicant: Bose Corporation, Framingham, MA (US)

(72) Inventors: Yashar Motedayen Aval, Bedford, MA (US); Siamak Farahbakhsh, Waltham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/185,435

(22) Filed: Feb. 25, 2021

(65) Prior Publication Data

US 2021/0264891 A1 Aug. 26, 2021

Related U.S. Application Data

(60) Provisional application No. 62/981,315, filed on Feb. 25, 2020.

(51) Int. Cl.
*G10K 11/178* (2006.01)

(52) U.S. Cl.
CPC .. *G10K 11/17823* (2018.01); *G10K 11/17873* (2018.01); *G10K 2210/1282* (2013.01); *G10K 2210/3011* (2013.01); *G10K 2210/3027* (2013.01); *G10K 2210/3044* (2013.01)

(58) Field of Classification Search
CPC ..... G10K 11/17823; G10K 11/17873; G10K 2210/1282; G10K 2210/3011; G10K 2210/3027; G10K 2210/3044
USPC ..... 381/74.1
See application file for complete search history.

(56) References Cited

U.S. PATENT DOCUMENTS

| | | | | |
|---|---|---|---|---|
| 5,953,428 | A * | 9/1999 | Silverberg | G10K 11/17883 381/71.8 |
| 6,493,689 | B2 | 12/2002 | Kotoulas et al. | |
| 7,224,807 | B2 | 5/2007 | Welsh et al. | |
| 9,153,226 | B2 | 10/2015 | Wurm | |
| 10,121,464 | B2 | 11/2018 | Lee et al. | |
| 2017/0140747 | A1* | 5/2017 | Judd | G10K 11/17827 |
| 2019/0270350 | A1* | 9/2019 | Bastyr | G10K 11/1785 |

FOREIGN PATENT DOCUMENTS

| | | |
|---|---|---|
| CN | 110232906 A | 9/2019 |
| EP | 3367378 A1 | 8/2018 |

OTHER PUBLICATIONS

International Search Report and Written Opinion dated Jun. 2, 2010 for PCTUS2021/019664.

* cited by examiner

*Primary Examiner* — Paul Kim
*Assistant Examiner* — Douglas J Suthers
(74) *Attorney, Agent, or Firm* — Bose Corporation

(57) ABSTRACT

Noise cancellation systems and methods are provided that generate an anti-noise signal configured to destructively interfere with noise in a cancellation zone. The systems and methods receive a signal representative of the noise in the cancellation zone. The signal is analyzed to identify a frequency to be reduced in the cancellation zone, and the signal is down converted to place the identified frequency at baseband. A baseband anti-noise signal is generated based upon the down converted signal. The baseband anti-noise signal is up converted to the identified frequency to produce an anti-noise signal having components at the identified frequency, and the anti-noise signal is provided to be transduced into an acoustic signal.

20 Claims, 4 Drawing Sheets

NARROWBAND CANCELLATION

CROSS REFERENCE TO RELATED APPLICATIONS

This application claims the benefit of U.S. Patent Application Ser. No. 62/981,315, filed on Feb. 25, 2020, titled NARROWBAND CAVITY RESONANCE CANCELLATION, the content of which is incorporated herein in its entirety for all purposes.

BACKGROUND

Active acoustic noise cancellation systems generate anti-noise signals to be transduced into acoustic signals intended to destructively interfere with undesired acoustic noise such that the undesired noise is reduced. These systems can operate on a very personal level, such as in headphones, or in a broader noise reduction zone, such as a region near a user's head. Automotive systems may operate to reduce acoustic noise near one or more occupants' heads and/or more generally throughout the vehicle interior. Some such systems may include sensors to detect the source of the noise and provide a reference signal correlated to the undesired sound, as in feedforward systems. Various systems include error sensors, such as microphones, to detect the resulting acoustic sound in the zone of interest and provide error signals, as a feedback signal, such that the system may adjust. Various noise cancellation systems may use one or more reference signals and/or error signals to adjust one or more anti-noise signals, transduced by various loudspeakers, to optimize reduction of noise in the zone.

SUMMARY

Systems and methods disclosed herein are directed to audio systems and methods that use one or more microphones to detect narrowband acoustic noise and to generate one or more driver signals to be transduced by one or more speakers to cause a reduction in the acoustic noise level in the region of the microphone(s). In various examples, narrowband noise may be associated with a resonance of an acoustic region, such as a wheel cavity (e.g., a standing wave inside the wheel of an automobile) or a cabin of a vehicle.

In certain examples, audio systems and methods herein may select one or more frequency ranges in which to analyze microphone signal(s) to detect the presence of narrowband noise, such as may be related to a resonance, and to identify the frequency, phase, and width of the narrowband noise. In some examples, frequency ranges in which various resonances or other narrowband noise occur may be known to the system a priori, and the system may analyze a spectrum of the microphone signal(s) to find a resonant peak within the frequency range. The system uses a portion of the signal around the peak as a feedback signal to actively generate one or more anti-noise signals.

According to various aspects, noise cancellation systems and methods are provided that receive a signal representative of noise in a cancellation zone, identify a frequency within the signal to be reduced in the cancellation zone, down convert the signal to place the identified frequency component at baseband, generate a baseband anti-noise signal based upon the down converted signal, up convert the baseband anti-noise signal to the identified frequency to produce an anti-noise signal having components at the identified frequency, and provide the anti-noise signal to be transduced into an acoustic signal.

In some examples, the signal representative of noise in the cancellation zone is a microphone signal.

According to various examples, identifying a frequency within the signal to be reduced in the cancellation zone may include analyzing the signal to identify a frequency having a peak in the spectrum of the signal. In certain examples, identifying a frequency within the signal to be reduced in the cancellation zone may include down converting the signal to baseband and analyzing the down converted signal to identify one or more peaks in the spectrum of the down converted signal.

According to various examples, identifying a frequency within the signal to be reduced in the cancellation zone may include analyzing the signal in a pre-selected range of frequencies. In certain examples, the pre-selected range of frequencies may be associated with a cavity resonance. Further in particular examples, the cavity resonance may be associated with at least one of a wheel cavity and a vehicular cabin cavity.

In some examples, the anti-noise signal having components at the identified frequency is a narrowband anti-noise signal having components at and around the identified frequency. The components at and around the identified frequency may be limited to a range of frequencies 20 Hz below the identified frequency and 20 Hz above the identified frequency, in various examples. The components at and around the identified frequency is limited to a range of frequencies 10 Hz below the identified frequency and 10 Hz above the identified frequency, in certain examples.

According to various examples, the anti-noise signal includes frequency components having amplitude and phase characteristics to destructively interfere with narrowband noise at or around the identified frequency.

Some example noise cancellation systems may include a sensor to provide the signal representative of noise in a cancellation zone. The sensor may be a microphone.

Some example noise cancellation systems may include a loudspeaker that receives the anti-noise signal and transduces the anti-noise signal into an acoustic signal.

Some example noise cancellation systems may include a controller configured to perform the noise cancellation method. The controller may include a processor and a memory in various examples.

Still other aspects, examples, and advantages of these exemplary aspects and examples are discussed in detail below. Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the inventions. In the figures, identical or nearly identical components illustrated in various figures may be represented by a like reference character or numeral. For purposes of clarity, not every component may be labeled in every figure. In the figures.

DETAILED DESCRIPTION

Aspects of the present disclosure are directed to noise cancellation systems and methods that use a microphone to provide a feedback signal and that analyze the feedback signal for the presence of narrowband noise in pre-selected frequency ranges. Such narrowband noise may be associated with resonant noise sources. In some examples, the resonant noise sources may be associated with an acoustic volume, or cavity, such as a wheel cavity (the air space inside a tire) or a cabin cavity. Such resonant cavities may be pre-determined to produce narrowband resonant noise in one or more frequency ranges.

The systems and methods herein adapt to the feedback signal to provide anti-noise signals to be transduced by one or more loudspeakers to interfere with the narrowband noise and thereby reduce the level of narrowband noise in a listening region. In various examples, noise cancellation systems and methods herein may be integrated with various audio systems that also include audio for entertainment, communication, guidance, warning prompts, and the like. In various examples, noise cancellation systems and methods herein may provide the anti-noise signal(s) to a separate audio system to be included in various driver signals to loudspeakers, such as may also include other audio for entertainment, communication, guidance, warning prompts, and the like.

Figure 1:
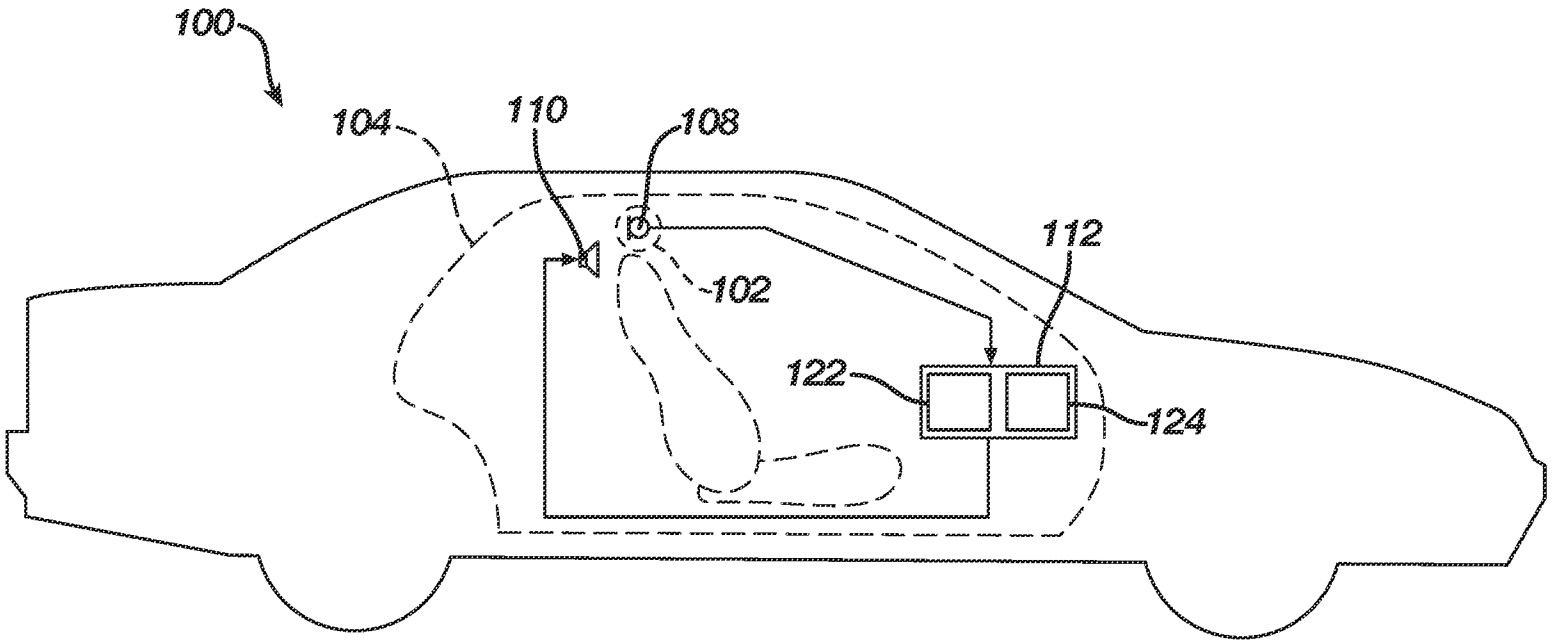
FIG. 1 is a schematic diagram of an example noise cancellation system.

FIG. 1 is a schematic view of an example noise-cancellation system 100. Noise-cancellation system 100 can be configured to destructively interfere with undesired sound in at least one cancellation zone 102 within a predefined volume 104 such as a vehicle cabin. At a high level, an example of noise-cancellation system 100 may include one or more microphones 108, one or more loudspeakers 110, and a controller 112. Some examples may include a reference sensor, such as may sense a vibration of one or more components. Some examples may include other reference inputs, such as for receiving information about vehicle speed, engine RPM, torque, etc., such as information from which the controller 112 may determine a range of frequencies in which to analyze microphone signals for narrowband noise.

One or more anti-noise signals can be generated by controller 112 and provided to the one or more loudspeakers 110 in the predefined volume, which transduce the anti-noise signal(s) into acoustic energy (i.e., sound waves). The acoustic energy produced as a result is approximately 180° out of phase with—and thus destructively interferes with—the undesired sound within the cancellation zone 102. The combination of sound waves generated from the anti-noise signal(s) and the undesired noise in the predefined volume results in a reduction of the undesired noise, as perceived by a listener in the cancellation zone 102.

Microphone 108, disposed within the predefined volume, generates an error signal based on detection of residual noise resulting from the combination of the sound waves in the cancellation zone, including the undesired noise. The error signal is provided to controller 112 as feedback, the error signal at least partially representing residual noise uncanceled by the anti-noise signal(s). Microphone 108 can be, for example, at least one microphone mounted within a vehicle cabin (e.g., in the roof, headrests, pillars, or elsewhere within the cabin).

It should be noted that the cancellation zone(s) can be positioned remotely from microphone 108. In such case, the error signal may be filtered to represent an estimate of the residual noise in the cancellation zone(s). In either case, the error signal will be understood to represent residual undesired noise in the cancellation zone.

In various examples, controller 112 can comprise a non-transitory storage medium 122 and a processor 124. In an example, non-transitory storage medium 122 can store program code that, when executed by processor 124, implements the various filters and algorithms described below. Controller 112 can be implemented in hardware and/or software. For example, the controller can be implemented by a SHARC floating-point DSP processor, but it should be understood that controller 112 can be implemented by any other processor, FPGA, ASIC, or other suitable hardware.

Figure 2:
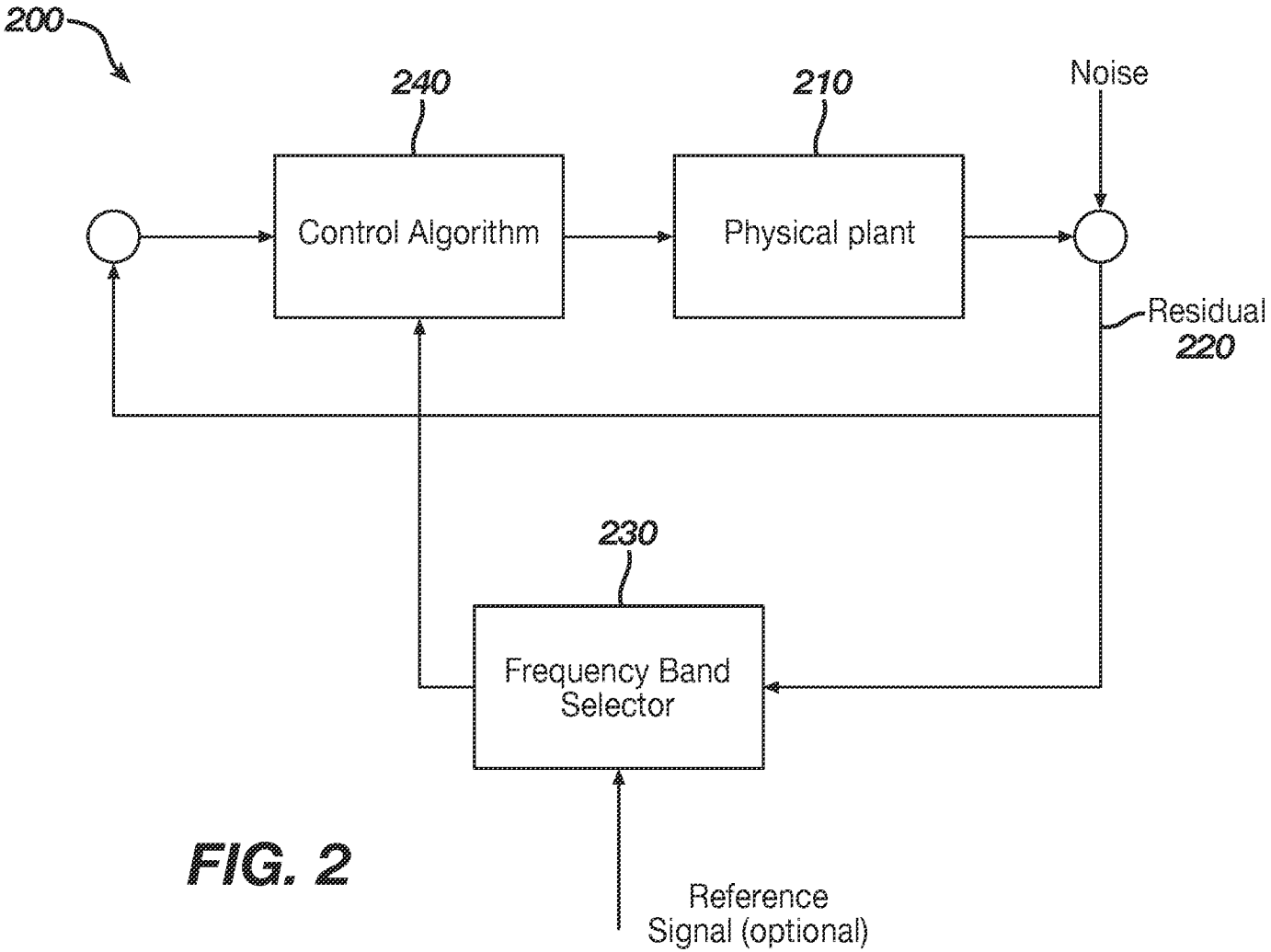
FIG. 2 is a schematic block diagram of an example operation of the noise cancellation system of FIG. 1.

FIG. 2 illustrates an example operation method 200 of the noise-cancellation system 100 including processes performed by the controller 112. The physical plant 210 represents the physical transfer function of the anti-noise signal(s) through the loudspeakers 110, the vehicle interior (e.g., the predefined volume 104), and the response of the microphone(s) 108. The microphone(s) 108 provide a residual signal 220 resulting from the anti-noise signal(s) and the undesired noise in the cancellation zone 102. The residual signal 220 may also be referred to as a microphone signal. A frequency band selector 230 receives the microphone signal and analyzes it for narrowband noise in one or more selected frequency ranges. The frequency band selector 230 provides information to a control algorithm 240, and such information identifies one or more frequencies at which narrowband noise exists in the microphone signal. The control algorithm 240 receives the microphone signal and generates the anti-noise signal(s) intended to reduce the narrowband noise at each of the one or more identified frequencies. In various examples, the anti-noise signal(s) reduce the narrowband noise within a range of frequencies around one or more of the identified frequencies.

Figure 3:
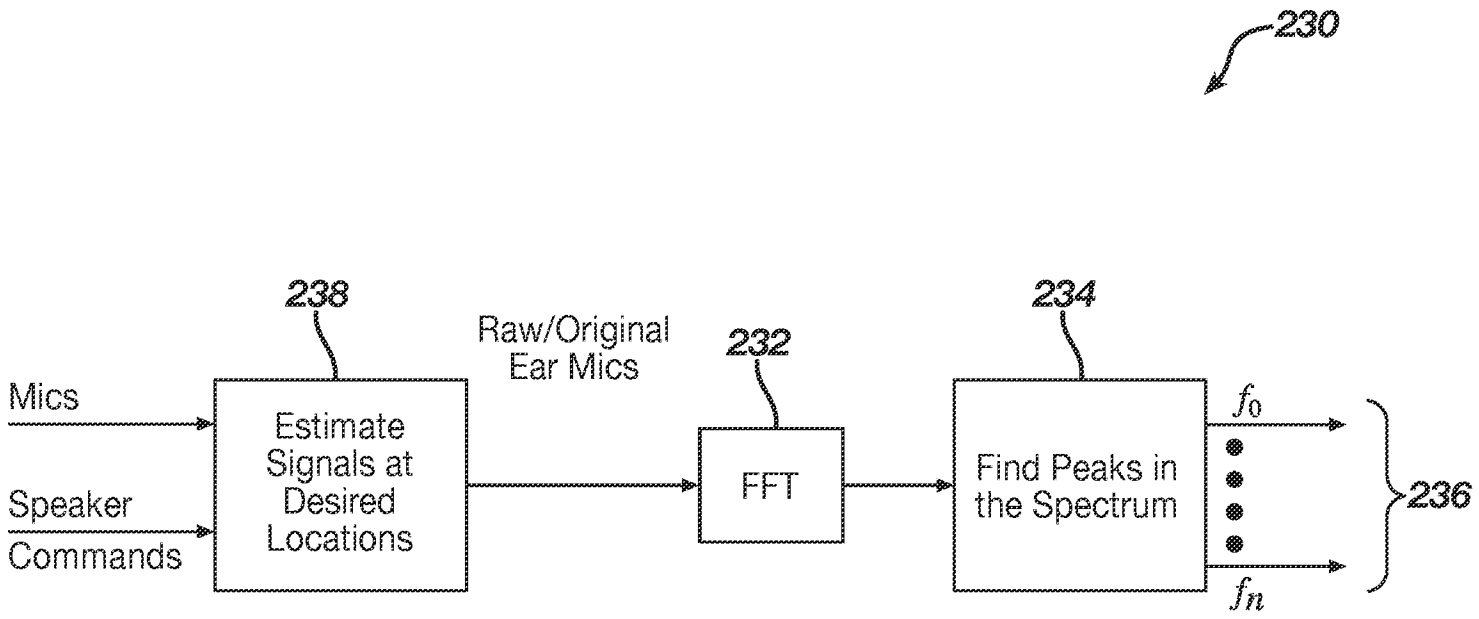
FIG. 3 is a schematic block diagram of an example frequency band selector of FIG. 2.

FIG. 3 illustrates an example frequency band selector 230. The frequency band selector may convert a signal into a frequency domain representation, such as via an FFT 232, and finds peaks in the spectrum at block 234. The frequency band selector 230 identifies one or more identified frequencies 236 that have such peaks in the spectrum. In some examples, block 234 may look at only selected portions of the spectrum where narrowband noise may be expected, such as frequency ranges where a cavity resonance may be expected. In such examples, block 234 may analyze one or more pre-selected frequency ranges. In various examples, a down conversion may be performed prior to the FFT 232, to shift one or more pre-selected frequency ranges to baseband, which may reduce computational resources required to perform the FFT 232 and to finds peaks in the spectrum at block 234. Other examples may identify one or more frequencies 236 that have peaks in the spectrum from other narrowband sources, e.g., not necessarily related to cavity resonances. Accordingly, a frequency 236 may be identified for any narrowband noise based upon peaks in a signal spectrum.

In some examples, the frequency band selector 230 may operate to identify frequencies in the microphone signal. In other examples, the frequency band selector 230 may also receive speaker command signal(s), which represent the anti-noise signal(s) being transduced by the loudspeaker(s). In such examples, a block 238 may estimate an original signal at a location, e.g., an acoustic signal that would have existed at the location in the absence of the anti-noise signal, e.g., as if the noise cancellation system were not in operation. Such may be desirable, for example, if the noise cancellation system 100 is operating fairly well to reduce the narrowband noise and therefore the signals directly from the microphone(s) may not include peaks at the identified frequencies, e.g., because the noise cancellation system 100 is effectively reducing acoustic content at the identified frequencies.

Figure 4:
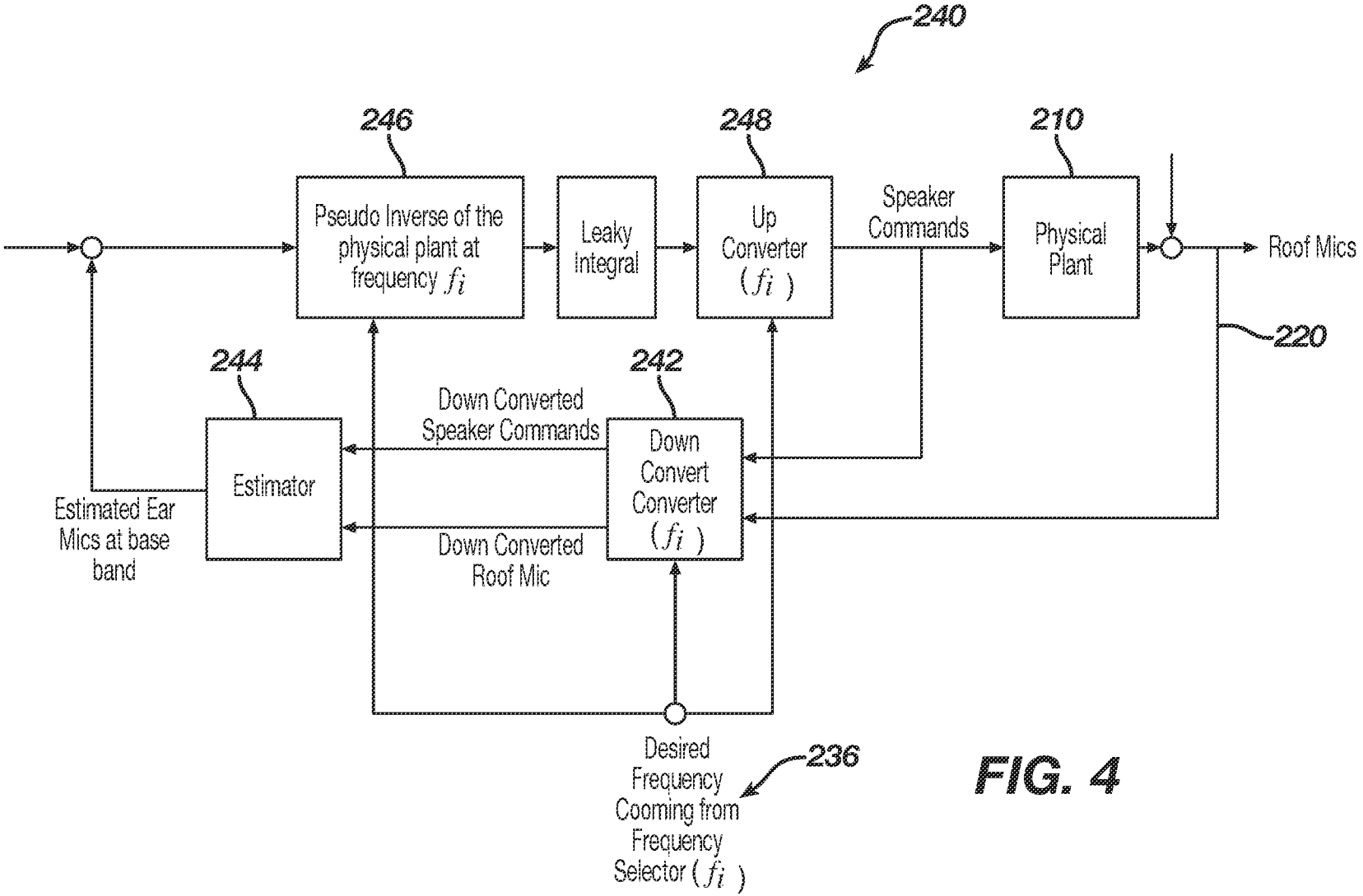
FIG. 4 is a schematic block diagram of an example control algorithm of FIG. 2.

FIG. 4 illustrates one example of the control algorithm 240. The control algorithm 240 receives the identified frequencies 236 from the frequency band selector 230. For each identified frequency, a downconverter 242 converts the spectrum of the microphone signal(s) and the speaker command signal(s) at (or around) the identified frequency down to baseband. An estimator 244 receives the baseband microphone and speaker command signal(s) and estimates a baseband version of the narrowband noise at the identified frequency (which may be an estimate at a particular location, such as at the location of an occupant's ears). The estimated baseband noise may be processed through an inverse 246 of physical plant (at baseband), also known in some cases as an inverse of the secondary path, to generate a baseband anti-noise signal, which is upconverted by an upconverter 248 to provide an anti-noise signal (which are speaker command signal(s)).

The example frequency band selector 230 and example control algorithm 240 of FIGS. 3 and 4, respectively, are each merely one example of their respective components of the noise cancellation system 100, and other suitable arrangements exist. Some examples may include one or more adaptive algorithms to adjust an anti-noise signal in response to a feedback (residual) signal form a microphone. For example, the inverse 246 may be implemented as a fixed filter or may be adaptive and "learn" the relationship between the speaker commands and the resulting residual signal.

At least one benefit of the example noise cancellation system 100, and the control algorithm 240, is that the described down conversion to baseband may allow implementation of narrowband processing with a reduced requirement for number of filter taps. For example, the inverse 246 may be implemented by a filter at baseband with fewer taps to achieve the same narrowband operation as one that operates on signals at the identified frequency.

Any suitable hardware and/or software, including firmware and the like, may be configured to carry out or implement components of the aspects and examples disclosed herein, and various implementations of aspects and examples may include components and/or functionality in addition to those disclosed. Various implementations may include stored instructions for a digital signal processor and/or other processing circuitry to enable the circuitry, at least in part, to perform the functions described herein.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

Also, the phraseology and terminology used herein is for the purpose of description and should not be regarded as limiting. Any references to examples, components, elements, acts, or functions of the systems and methods herein referred to in the singular may also embrace embodiments including a plurality, and any references in plural to any example, component, element, act, or function herein may also embrace examples including only a singularity. Accordingly, references in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation, unless the context reasonably implies otherwise.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A method of reducing noise comprising:

receiving a sensor signal from a sensor in a cancellation zone;

estimating a signal representative of noise in the cancellation zone based at least in part upon the sensor signal;

identifying a frequency within the estimated signal to be reduced in the cancellation zone;

down converting the sensor signal to place the identified frequency at baseband;

down converting a speaker command signal to place the identified frequency at baseband;

generating a baseband estimated ear signal based upon the down converted sensor signal and the down converted speaker command signal;

generating a baseband anti-noise signal from the baseband estimated ear signal;

up converting the baseband anti-noise signal to the identified frequency to produce an anti-noise signal having components at the identified frequency; and providing the anti-noise signal to be transduced into an acoustic signal.

2. The method of claim 1 wherein the sensor signal is a microphone signal.

3. The method of claim 1 wherein identifying a frequency within the estimated signal to be reduced in the cancellation zone includes analyzing the estimated signal in a pre-selected range of frequencies.

4. The method of claim 3 wherein the pre-selected range of frequencies is associated with a cavity resonance.

5. The method of claim 4 wherein the cavity resonance is associated with at least one of a wheel cavity and a vehicular cabin cavity.

6. The method of claim 1 wherein the anti-noise signal having components at the identified frequency is a narrowband anti-noise signal having components at and around the identified frequency.

7. The method of claim 6 wherein the components at and around the identified frequency is limited to a range of frequencies 20 Hz below the identified frequency and 20 Hz above the identified frequency, or narrower.

8. The method of claim 6 wherein the components at and around the identified frequency is limited to a range of frequencies 10 Hz below the identified frequency and 10 Hz above the identified frequency, or narrower.

9. The method of claim 1 wherein the anti-noise signal includes frequency components having amplitude and phase characteristics to destructively interfere with narrowband noise at or around the identified frequency.

10. The method of claim 1 wherein identifying a frequency within the estimated signal comprises analyzing the estimated signal to identify a frequency having a peak in the spectrum of the estimated signal.

11. A noise cancellation system comprising:

a sensor in a cancellation zone configured to provide a sensor signal; and a controller coupled to the sensor and configured to:

receive the sensor signal from the sensor, estimate a signal representative of noise in the cancellation zone based at least in part upon the sensor signal, identify a frequency within the estimated signal to be reduced in the cancellation zone, down convert the sensor signal to place the identified frequency at baseband, down convert a speaker command signal to place the identified frequency at baseband, generate a baseband estimated ear signal based upon the down converted sensor signal and the down converted speaker command signal, generate a baseband anti-noise signal from the baseband estimated ear signal, up convert the baseband anti-noise signal to the identified frequency to produce an anti-noise signal having components at the identified frequency, and provide the anti-noise signal to be transduced into an acoustic signal.

12. The noise cancellation system of claim 11 wherein the sensor is a microphone.

13. The noise cancellation system of claim 11 wherein identifying a frequency within the estimated signal to be reduced in the cancellation zone includes analyzing the estimated signal in a pre-selected range of frequencies.

14. The noise cancellation system of claim 13 wherein the pre-selected range of frequencies is associated with a cavity resonance.

15. The noise cancellation system of claim 14 wherein the cavity resonance is associated with at least one of a wheel cavity and a vehicular cabin cavity.

16. The noise cancellation system of claim 11 wherein the anti-noise signal having components at the identified frequency is a narrowband anti-noise signal having components at and around the identified frequency.

17. The noise cancellation system of claim 16 wherein the components at and around the identified frequency is limited to a range of frequencies 20 Hz below the identified frequency and 20 Hz above the identified frequency, or narrower.

18. The noise cancellation system of claim 16 wherein the components at and around the identified frequency is limited to a range of frequencies 10 Hz below the identified frequency and 10 Hz above the identified frequency, or narrower.

19. The noise cancellation system of claim 11 wherein the anti-noise signal includes frequency components having amplitude and phase characteristics to destructively interfere with narrowband noise at or around the identified frequency.

20. The noise cancellation system of claim 11 further comprising a loudspeaker coupled to the controller that receives the anti-noise signal and transduces the anti-noise signal into an acoustic signal.

* * * * *